US005233952A

United States Patent [19]

Isaka

[11] Patent Number: 5,233,952

[45] Date of Patent: Aug. 10, 1993

[54] PUMP DRIVE FOR ENGINE

[75] Inventor: Yoshiharu Isaka, Iwata, Japan

[73] Assignee: Yamaha Hatsudoki Kabushiki Kaisha, Iwata, Japan

[21] Appl. No.: 733,093

[22] Filed: Jul. 19, 1991

[30] Foreign Application Priority Data

Jul. 19, 1990 [JP] Japan ..... 2-192253

[51] Int. Cl.[5] ..... F02B 33/22; F02M 37/06; F02M 67/02; F02N 3/04

[52] U.S. Cl. ..... 123/179.17; 123/179.18; 123/509; 123/533; 123/41.31

[58] Field of Search ..... 123/179.16, 179.17, 123/179.18, 533, 41.31, 509

[56] References Cited

U.S. PATENT DOCUMENTS

| | | | |
|---|---|---|---|
| 1,659,043 | 2/1928 | Müller | 123/533 |
| 1,938,270 | 12/1933 | Woolson | 123/179.17 |
| 2,038,214 | 4/1936 | Gerandt | 123/533 |
| 2,904,027 | 9/1959 | Zubaty | 123/179.16 |
| 3,363,614 | 1/1968 | Fisher . | |
| 3,455,105 | 7/1969 | Ito et al. . | |
| 3,577,965 | 5/1971 | Sundberg . | |
| 3,690,768 | 9/1972 | Nagasawa . | |
| 3,889,879 | 6/1975 | Wellman et al. | 123/41.31 |
| 4,117,821 | 10/1978 | Kawai . | |
| 4,295,798 | 10/1981 | McIntosh | 417/212 |
| 4,411,237 | 10/1983 | Ableitner et al. | 123/501 |
| 4,421,076 | 12/1983 | Sasaki | 123/179.17 |
| 4,453,522 | 6/1984 | Salzgeber | 123/502 |
| 4,586,468 | 5/1986 | Dzioba | 123/198 C |
| 4,756,293 | 7/1988 | Suziki et al. | 123/531 |
| 4,867,115 | 9/1989 | Henein | 123/179.17 |
| 4,899,714 | 2/1990 | Schechter et al. | 123/533 |
| 4,936,279 | 6/1990 | Ragg | 123/179.17 |

FOREIGN PATENT DOCUMENTS

| | | | |
|---|---|---|---|
| 57-193722 | 11/1982 | Japan | 123/179.16 |
| 2222435 | 3/1990 | United Kingdom . | |

*Primary Examiner*—Andrew M. Dolinar
*Attorney, Agent, or Firm*—Ernest A. Beutler

[57] ABSTRACT

A power unit for a small vehicle such as a motorcycle embodying a two-cycle, crankcase compression, air/fuel injected engine. Fuel and air pumps are driven by the engine and are positioned inwardly of the outer extremity of a plane defined by the outer face of the clutch of the engine transmission assembly and the adjacent side of the engine. A two speed drive is provided for the air pump of the fuel/air injection system so as to operate the air pump at a higher speed ratio during cranking than during running so as to insure adequate air supply for the engine even during starting.

23 Claims, 4 Drawing Sheets

PUMP DRIVE FOR ENGINE

BACKGROUND OF THE INVENTION

This invention relates to a pump drive for an engine and more particularly to an improved arrangement for driving components for the fuel injection system of an engine.

The advantages of fuel injection for application to internal combustion engines are well known. It has been recognized that the performance, particularly of two-cycle engines, can be significantly improved through the use of fuel injection. One form of fuel injection that has been proposed for such applications injects, in addition to fuel, high pressure air into the engine. Although these types of injectors have some advantages, because of the fact that both fuel and air are injected, it is necessary to provide high pressure sources of both fuel and air. This can present some problems, particularly with certain types of application.

Two-cycle engines are widely used for propulsion devices in small vehicles such as motorcycles. However, due to the extremely small space available, it has been difficult to provide a motorcycle engine with the necessary air and fuel compressors for an air/fuel injection system.

It is, therefore, a principal object of this invention to provide an improved and compact pump drive for an engine.

It is a further object of this invention to provide an improved and compact pump and drive arrangement for an engine fuel injection system.

In addition to the normal running conditions of an engine, it is also necessary to supply fuel and air to the engine during starting. Many of the pumps employed with fuel injection systems are driven at a fixed ratio relative to the engine speed so as to generate the appropriate pressure. However, during cranking, the engine speed is quite low and the conventional speed ratio chosen to drive a pump for the fuel injection system may be too slow to insure adequate supply of the fluid being pumped during starting.

It is, therefore, a further object of this invention to provide an improved arrangement for driving a pump from an engine output shaft at a higher speed ratio during starting than during running.

It is a further object of this invention to provide an improved two speed pump arrangement for an injection system of an internal combustion engine.

As is well known, when a fluid is being pumped and compressed, the fluid tends to become heated. This is particularly true when air is being compressed and pumped. The heating of the air can reduce the volumetric efficiency of the pump. Although a variety of cooling arrangements have been employed, these generally rely upon air cooling of the air compressor and do not afford maximum volumetric efficiency.

It is, therefore, a further object of this invention to provide an improved liquid cooling system for the air pump of a fuel air injection system for an engine.

It is a further object of this invention to provide an improved arrangement for cooling the air pump of an injection system of an engine with the liquid cooling system of the engine.

SUMMARY OF THE INVENTION

A first feature of this invention is adapted to be embodied in an internal combustion engine comprised of a cylinder block assembly and a crankcase assembly at a base of the cylinder block assembly. An output shaft is driven by the engine and has an end thereof that extends out of one side of the engine and which drives an output element. The engine has an injection system and a pump for the injection system is driven by the engine. The pump is disposed at the one side of the engine and lies substantially between a plane containing the outer end of the output element and the one side of the engine.

Another feature of the invention is adapted to be embodied in an internal combustion engine having an output shaft and a starter for starting the engine. The engine is also provided with an injection system that includes a pump. In accordance with this feature of the invention, the pump is driven at a higher speed ratio when the starting device is operated than when the engine is running so as to provide additional fluid during starting.

A further feature of this invention is adapted to be embodied in a water cooled internal combustion engine having a cooling jacket. The engine is provided with an injection system and a pump for supplying fluid under pressure to the injection system. In accordance with this feature of the invention, the pump is provided with a cooling jacket and liquid coolant from the engine cooling jacket is circulated through the pump cooling jacket.

DETAILED DESCRIPTION OF THE PREFERRED EMBODIMENT

Figure 1:
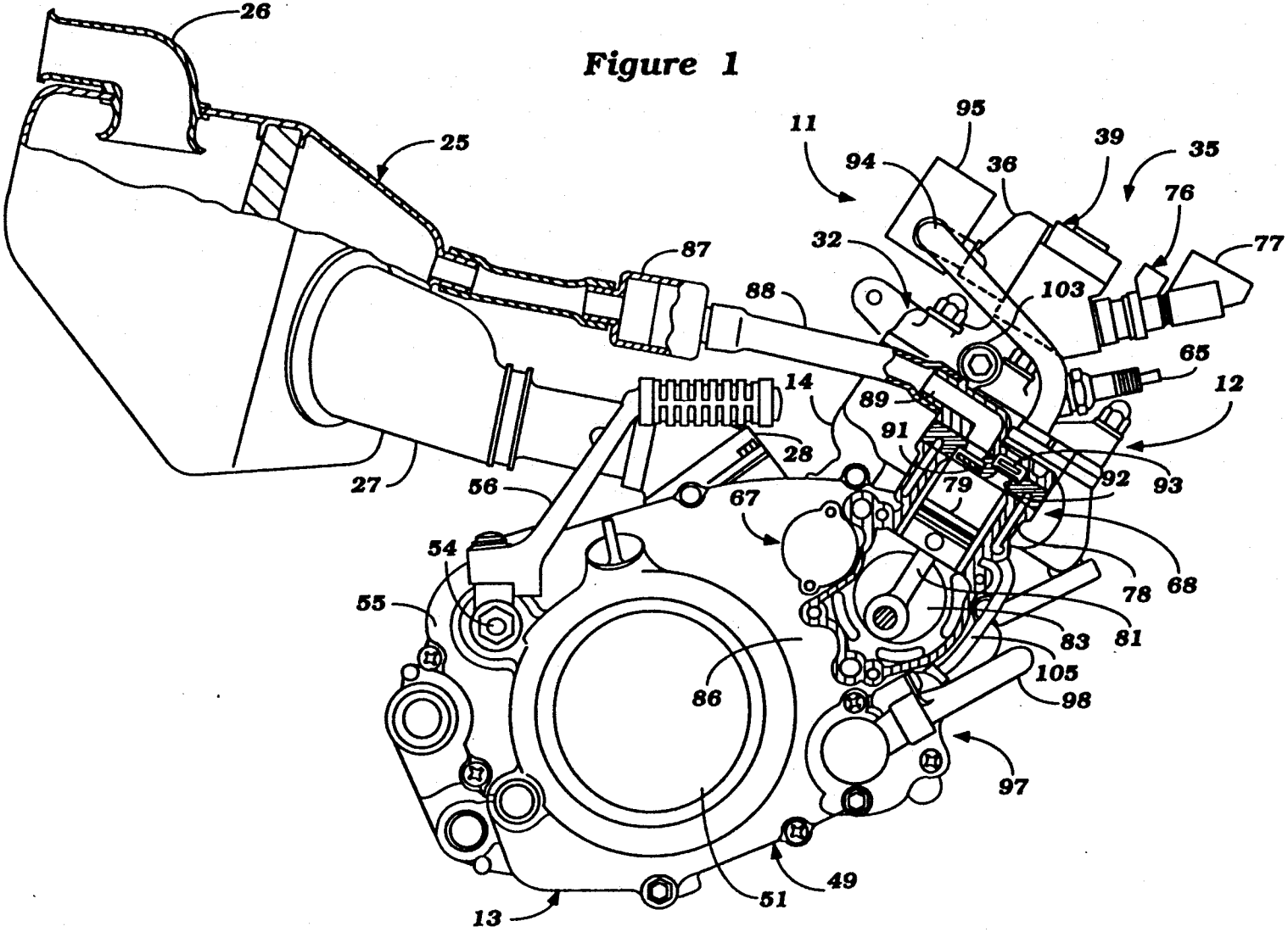
FIG. 1 is a side elevational view, with a portion broken away, of an internal combustion engine for a motorcycle constructed in accordance with an embodiment of the invention.

Referring now in detail to the drawings, the reference numeral 11 indicates generally a power unit for a motorcycle. As is typical with motorcycle practice, the power unit 11 includes an internal combustion engine, indicated generally by the reference numeral 12, and which engine has a crankcase assembly, indicated generally by the reference numeral 13, that contains a combined change speed transmission and engine crankcase. Although the invention is described in conjunction with a power unit for a motorcycle, wherein it has particular utility, it is to be understood that the invention may be employed with other applications for internal combustion engines. However, the invention has particular utility in conjunction with motorcycle applications due to their compact nature and the spacial requirements thereof.

The engine 12 is comprised of a cylinder block assembly 14 which, in the illustrated embodiment, has a single cylinder bore 15 formed by a pressed-in liner 16. A piston 17 reciprocates within the cylinder bore 15 and is connected by means of a connecting rod 18 to a throw 19 of an output shaft in the form of a crankshaft 21. The crankshaft 21 is mounted in the casing assembly 22 of the combined crankcase transmission assembly 13 by means of a pair of spaced apart roller bearings 23. In the illustrated embodiment, the engine 12 operates on a two-stroke, crankcase compression principle and, therefore, a chamber 24 of the crankcase is provided which is sealed and to which an air charge is delivered from an air induction system as best shown in FIG. 1.

The air induction system includes a combined air cleaner, air silencer 25 that draws atmospheric air through an inlet 26. The air is then delivered through an outlet passageway 27 to the crankcase chamber 24 through an intake manifold 28 in which a reed-type check valve assembly (not shown) is provided so as to preclude reverse flow.

The air charge which is admitted to the crankcase chamber 24 upon upward movement of the piston 17 is compressed upon its downward movement and is then transferred through a plurality of scavenge passages 29 (FIG. 2) which terminate in scavenge ports 31 to the area above the head of the piston 17.

A cylinder head assembly 32 is affixed in a suitable manner to the cylinder block 14 and has a recess 33 which defines a combustion chamber 34 with the cylinder bore 15 and head of the piston 17.

A fuel/air charge is delivered to the combustion chamber 34 from a furl/air injector, indicated generally by the reference numeral 35. The fuel/air injector 35 may be of any known type and includes a housing assembly 36 that defines an internal chamber (not shown) to which fuel and air are delivered under pressure in a manner which will be described. An injection valve, shown in cross-section in FIG. 2 and identified by the reference numeral 37, has a stem portion 38 that is operated by an electrical solenoid assembly 39 for controlling the communication of this chamber with the combustion chamber 34. As has been previously noted, the internal construction of the fuel/air injector 35 may be of any known type. Also, although the invention is described in conjunction with a fuel/air injector, certain facets of the invention can be employed with engines having only fuel injection.

An internal wall 41 of the crankcase casing 22 separates the crankcase chamber 24 from a change speed transmission chamber, indicated generally by the reference numeral 42 and which rotatably journals a primary transmission shaft 43 and a secondary or output transmission shaft 44 for rotation about axes parallel to the axis of rotation of the crankshaft 21. A drive gear 45 is affixed to an end 46 of the crankshaft 21 which extends through the sidewall of the crankcase housing 22 at one side of the engine. The gear 45 is in mesh with a gear 47 which is journaled on the transmission primary shaft 43 and which drives an output element in the form of a clutch assembly, indicated generally by the reference numeral 48. The clutch assembly 48 is contained within a cover plate 49 having a domed portion 51 which encircles the clutch assembly 48.

The primary and secondary transmission shafts 43 and 44 each carry a plurality of gear sets 52 and 53 which intermesh with each other and which can be suitably coupled for rotation with their respective shafts 43 and 44 so as to drive the secondary shaft 44 at a selected speed ratio relative to the primary shaft 43. These clutch assemblies are operated by means of a shift cam (not shown) that is also contained within the transmission case 22 and which is operated in a well known manner.

The power unit 11 is provided with a kick starter assembly which includes a starter shaft 54 which is journaled appropriately in a portion 55 of the cover plate 49. A kick starting pedal 56 is affixed to the exposed end of the kick starter shaft 54 and operates a starter gear 57 which, upon kick starting, will move into meshing relationship with a gear 58 journaled on the transmission secondary shaft 44. This gear 58, in turn, meshes with a starter gear 59 which is journaled on the transmission primary shaft 43. The gear 59 is in mesh with a starter gear 61 carried on the exposed crankshaft end 46. The gears 45 and 61 and a further gear, to be described, are all fixed for rotation with the crankshaft 21 by means of a key 62. As a result of this relationship, when the kick starter pedal 56 is operated, the engine crankshaft 21 will be rotated and starting facilitated.

On the end of the crankshaft 21 opposite that which drives the clutch 48, there is provided a magneto generator assembly 63 that is contained within a generator cover 64 at this side of the engine. The magneto generator 63 is connected to a tapered end 65 of the crankshaft 21 in a known manner. The magneto generator 63 supplies power to a circuit for firing a spark plug 65 (FIG. 1) for causing the fuel/air mixture to burn in the combustion chamber 34. The burnt charge is then exhausted through an exhaust port (not shown) and delivered to a suitable exhaust system (also not shown) in any well known manner.

A drive sprocket 66 is affixed to an end of the transmission secondary shaft 44 opposite the clutch 48 and drives a chain (not shown) for driving the rear wheel of the associated motorcycle in a well known manner.

Figure 3:
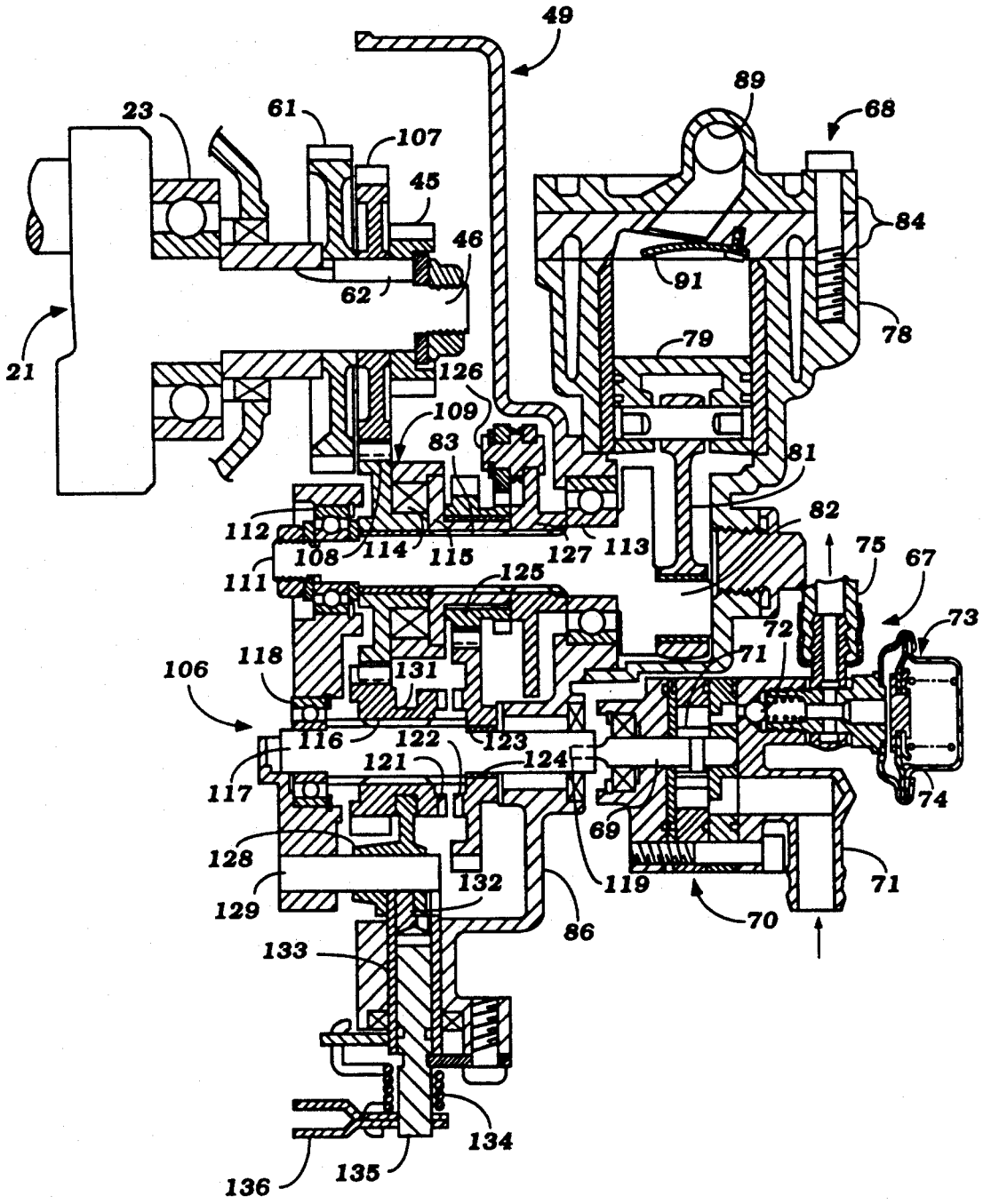
FIG. 3 is a further enlarged cross-sectional view showing the drive for the fuel and air pumps of the engine injection system.

As has been previously noted, the air/fuel injector 35 is provided with both fuel and air under pressure and the pumps for achieving this will now be described. The engine 12 drives a fuel pump regulator assembly, indicated generally by the reference numeral 67, and an air compressor, indicated generally by the reference numeral 68, in a manner which will be described. Referring primarily to FIG. 3, the fuel pump regulator assembly 67 includes a pump unit 70 of the gerotor type which has a drive shaft 69 that drives an external gear 71 which cooperates with an internal gear in a well known manner. Fuel is delivered to the pump 70 through an inlet fitting 71 from a remotely positioned fuel tank (not shown). This fuel is then discharged through a discharge valve 72 to a regulator assembly 73 of the type having a regulator diaphragm 74. Fuel pressure is regulator by dumping back excess fuel to the fuel tank through a suitable return line. A discharge conduit 75 delivers the fuel to a fuel injector 76 of the fuel injector 35 (FIG. 1) through a suitable conduit. The fuel/air injector 76 has an operating solenoid 77 that controls the discharge of fuel into the chamber of the fuel/air injector 35 as aforenoted.

Figure 2:
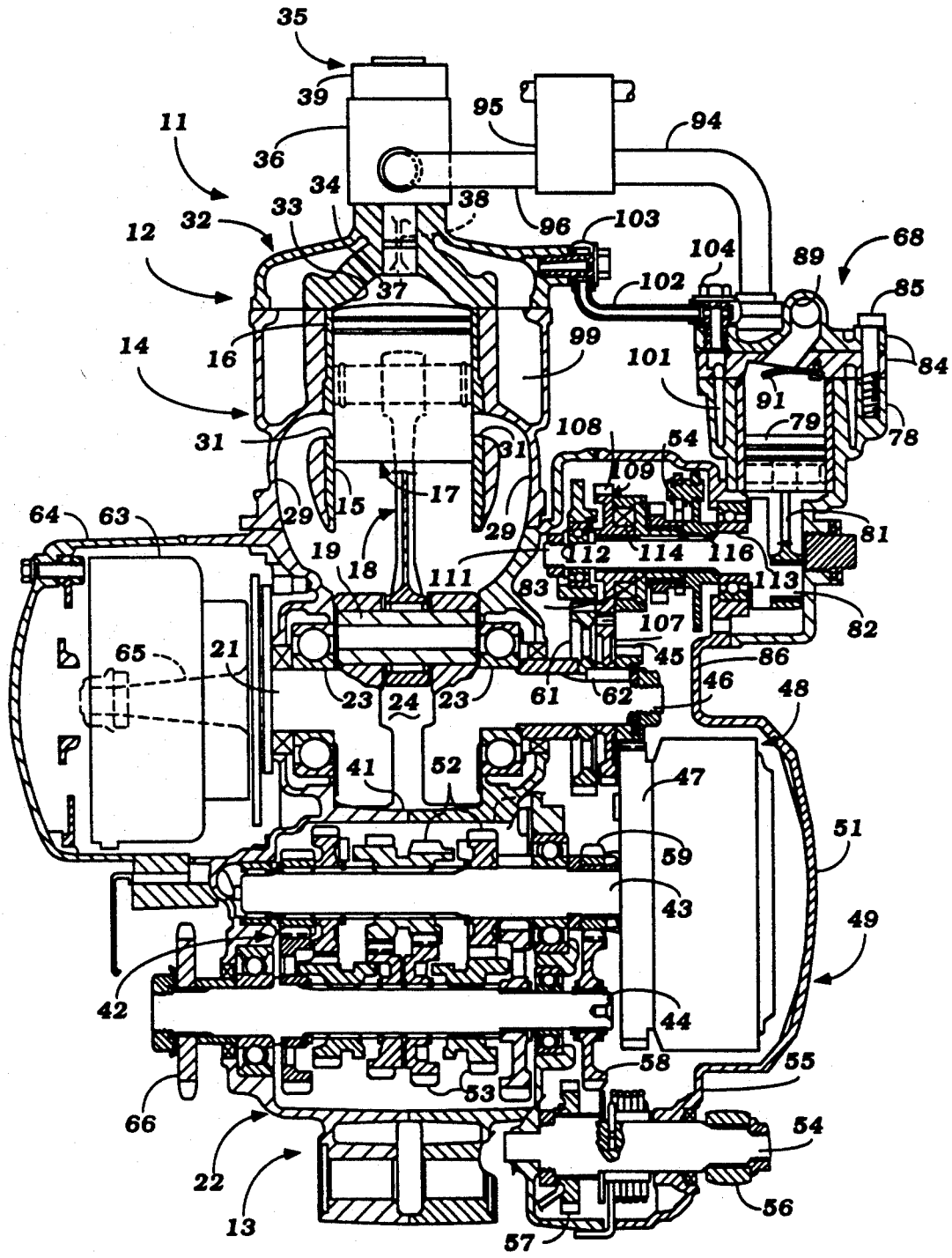
FIG. 2 is a cross-sectional view taken through the cylinder of the engine and through its change speed transmission.

Referring now to FIGS. 1 through 3, the air compressor 68 is of the reciprocating type and includes a cylinder block 78 that is formed with a cylinder bore in which a piston 79 reciprocates. The piston 79 is connected by means of a connecting rod 81 to an eccentric 82 of a crankshaft 83 which is driven in a manner to be described. The compressor cylinder block 78 has affixed to it a cylinder head assembly 84 by means of fasteners 85. As will be noted, the air compressor 68 is mounted on a portion 86 of the cover 49 and the air compressor 68 is positioned so that it lies substantially within a plane containing the outer portion of the clutch 48 and its cover portion 51 and the side of the engine through which the crankshaft portion 46 extends. The fuel pump 68 is also located within this plane so as to provide an extremely compact assembly, which is important in motorcycle applications.

Filtered air is supplied to the air compressor 68 through a conduit 87 from the downstream side of the air cleaner 25 and a delivery pipe 88 which communicates with an inlet port 89 formed in the cylinder head assembly 84. A delivery check valve 91 permits the air to be drawn into the compressor 68 during downward movement of the piston 79. Upon upward movement, the compressed air flows through a discharge port 92 in which a check valve 93 is provided for discharge through a delivery conduit 94. An air pressure regulator 95 communicates the conduit 94 with a conduit 96 that delivers the compressed air to an air manifold of the air/fuel injector 35.

It should be noted that the engine 11 is water cooled and for this purpose there is provided a water pump 97 (FIG. 1) that discharges coolant through a delivery conduit 98 to a cooling jacket 99 (FIG. 2) of the cylinder block 14 and cylinder head 32. The air compressor 68 is also water cooled and it has a cooling jacket 101 that communicates with the engine cooling jacket 99 through a delivery conduit 102 and fittings 103 and 104. The coolant is then returned back to the coolant pump 97 in a suitable manner through a return conduit 105. Because of this construction, the engine 12 and air compressor 68 will be adequately cooled and both can operate at optimum efficiency.

The transmission for driving the fuel pump assembly 67 and the air compressor 68 will now be described by particular reference to FIGS. 2 and 3 wherein this drive mechanism is indicated generally by the reference numeral 106. This drive assembly includes a driving gear 107 that is fixed for rotation with the crankshaft end 46 by the key 62 and between the gears 45 and 61. The gear 107 meshes with a driven gear 108 of a one-way clutch assembly, indicated generally by the reference numeral 109. The one-way clutch assembly 109 is journaled on an end 111 of the crankshaft 82 which is, in turn, supported for rotation by a gearing 112. The opposite end of the crankshaft 83 is also journaled by a bearing 113 adjacent the throw 82.

The one-way clutch 109 has clutching elements 114 that provide a driving connection to a driven sleeve 115 which has a splined connection to the crankshaft 83 for driving the air compressor 68.

The gear 108 is in mesh with a further gear 116 that has a splined connection to a fuel pump drive shaft 117. The fuel pump drive shaft 117 is journaled by a bearing 118 and has a tongue and groove connection 119 to the fuel pump shaft 69 for driving it.

The ratio of the gear drives for a air pump 68 and fuel pump 70 are such that adequate pressure will be present even when the engine is idle. The ratio is also chosen so that at maximum speed that not too great a pressure will be exerted by the outputs of these two pumps. However, during cranking of the engine for starting, the amount of air supplied by the air pump 68 will be relatively small. In order to provide adequate air for starting operation, the transmission arrangement 106 also includes an arrangement for providing extra air pressure under this cranking condition.

Figure 4:
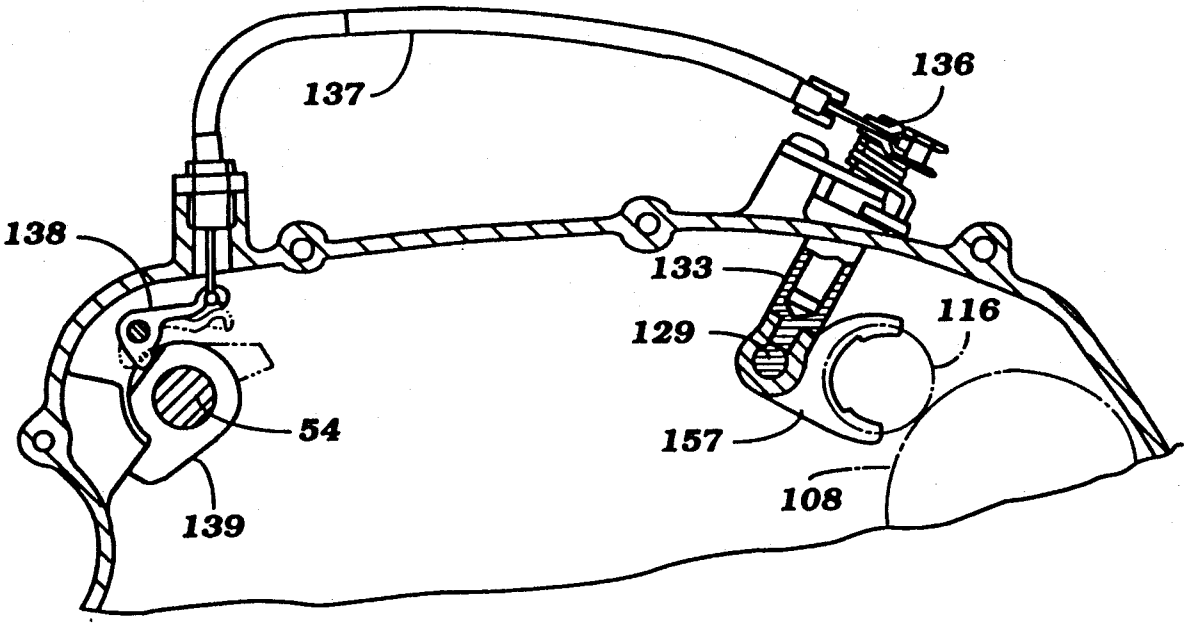
FIG. 4 is a cross-sectional view taken through the interconnection between the starter mechanism and the transmission of the pump drive.

This construction will now be described again by reference primarily to FIGS. 2, 3 and, additionally, FIG. 4. As may be seen in FIG. 3, the gear 161 has a splined connection to the shaft 117 and is provided with dog clutching teeth 121 which face corresponding dog clutching teeth 122 of a drive gear 123 that is journaled on the shaft 117 by means of a bushing 124. The dog clutching teeth 121 and 122 are brought into engagement with each other during cranking operation, in a manner to be described, so that the driven gear 123 will be driven from the shaft 117 during starting operation.

The gear 123 meshes with a gear 125 which is journaled on the hub 115 of the one-way clutch 109. This gear 125 has a hub portion which is connected by means of a torsional damper 126 to a further driven hub 127 which is splined to the crankshaft 83. The ratio between the gears described is such that the crankshaft 83 will be driven at a greater speed ratio during cranking operation than during running operation. As a result, when the starter pedal 56 is operated, the air pump 68 will be driven at a higher speed ratio so that the speed will more closely approach that during idle speed and adequate air supply will be provided to the fuel/air injector 35.

In order to effect engagement of the dog clutching teeth 121 and 122, there is provided a shift fork 128 that is slidably supported on a supporting post 129 and which is engaged in an annular recess 31 formed in a gear 116. The shift fork 128 is operated by an eccentric portion 132 of a shaft 133 that is supported in the cover 49 and specifically on the portion 86 thereon. The shaft 133 and shift fork 128 is normally urged to a disengaged position by means of a torsional spring 134.

A further shaft 135 is slidably positioned in the shaft 133 and has a suitable driving connection with it. A fork 136 is affixed to the shaft 135 and, as may be best seen in FIG. 4, a Boden wire actuator 137 is connected to the fork 136 for pivoting the shaft 135 and shaft 133 in a direction in opposition to the torsional spring 134 and to move the dog clutching teeth 121 and 122 into engagement. The Boden wire actuator 137 is operated by means of a lever 138 which is pivoted next to the starter shaft 54 and which is engaged by an operating cam 139 carried thereby so that when kick starting is accomplished, the dog clutching teeth 121 and 122 will be brought into engagement. During this operation, the overrunning or one-way clutch 109 will be disengaged. However, as soon as the engine starts to run, the overrunning clutch 109 will engage and the crankshaft 83 will be driven directly from the crankshaft through the gear train previously described.

It should be readily apparent from the foregoing description that the described construction permits a very compact assemblage since the pumps for the fuel injection system are positioned substantially inwardly of a plane containing the outer peripheral edge of the clutch or clutch housing. In addition, the drive for the air pump will insure that adequate air pressure is present for the air/fuel injector even during cranking operation. Also since the air compressor 68 is cooled by the engine coolant, it will have good volumetric efficiency.

In the illustrated embodiment, the air pump and fuel pump are driven from the clutch side of the engine. It is to be understood, however, that one or both of these components can be positioned on the side of the engine adjacent the flywheel magneto 63 and the elements can be positioned inwardly of a plane containing the outer surface of the flywheel generator and its cover 64 and the adjacent side of the engine.

It should be understood that the foregoing description is that of a preferred embodiment of the invention and that various changes and modifications can be made without departing from the spirit and scope of the invention, as defined by the appended claims.

What is claimed is:

1. An internal combustion engine comprised of a cylinder block assembly and a crankcase assembly at the base thereof, an output shaft driven by said engine and having an end thereof extending out of one side of said engine and driving an output element for driving a transmission, said engine having a fuel/air injection system, an air pump for said fuel/air injection system driven by said engine, said air pump being disposed at one side of said engine and having major portions thereof lying between a plane containing the end surface of said output element and the one side of the engine, and a fuel pump driven by the engine and also having major portions thereof disposed substantially between said plane and said one side of the engine.

2. An internal combustion engine as set forth in claim 1 wherein the air pump is driven selectively at either a low speed ratio from the engine output shaft and at a second higher speed ratio relative to the output shaft.

3. An internal combustion engine as set forth in claim 2 further including means for starting the engine and means for shifting the drive for the air pump to the faster speed ratio during starting.

4. An internal combustion engine as set forth in claim 3 wherein the engine is kick started and the transmission is shifted automatically upon operation of the kick starter.

5. An internal combustion engine as set forth in claim 4 wherein the output element comprises a clutch for transferring drive to an associated vehicle.

6. An internal combustion engine as set forth in claim 5 wherein the clutch transfers power to a change speed transmission.

7. An internal combustion engine as set forth in claim 6 wherein the transmission for driving the pump is contained within the crankcase assembly.

8. An internal combustion engine as set forth in claim 1 wherein the air pump is driven selectively at either a low speed ratio from the engine output shaft and at a second higher speed ratio relative to the output shaft.

9. An internal combustion engine as set forth in claim 8 further including means for starting the engine and means for shifting the drive for the pump to the faster speed ratio during starting.

10. An internal combustion engine as set forth in claim 8 wherein the engine is water cooled and wherein the pump is cooled by the coolant from the engine.

11. An internal combustion engine as set forth in claim 10 wherein the pump is a reciprocating pump having a cylinder block and cylinder head each formed with a cooling jacket.

12. An internal combustion engine as set forth in claim 1 wherein the engine is water cooled and wherein the air pump is cooled by the coolant from the engine.

13. An internal combustion engine as set forth in claim 12 wherein the air pump is a reciprocating pump having a cylinder block and cylinder head each formed with a cooling jacket.

14. An internal combustion engine comprised of a cylinder block assembly and a crankcase assembly at the base thereof, an output shaft driven by said engine and having an end thereof extending out of one side of said engine and driving an output element for driving a transmission, said engine having an injection system, a pump for said injection system driven by said engine by a two speed transmission having a low speed ratio and a high speed ratio, said pump being disposed at one side of said engine, a kick starter for starting of said engine and means for shifting said two speed transmission automatically from said low speed ratio to said high speed ratio upon operation of said kick starter.

15. An internal combustion engine as set forth in claim 14 wherein the output element comprises a clutch for transferring drive to an associated vehicle.

16. An internal combustion engine as set forth in claim 15 wherein the clutch transfers power to a change speed transmission.

17. An internal combustion engine as set forth in claim 16 wherein the two speed transmission for driving the pump is contained within the crankcase assembly.

18. An internal combustion engine having an injection system and a pump for supplying a fluid under pressure to said injection system, a kick starter for said engine, transmission means for driving said pump from said engine at selected first, low and second, high speed ratios, and means for shifting said transmission means from said first, low speed ratio to said second, high speed ratio upon operation of said kick starter.

19. An internal combustion engine as set forth in claim 18 wherein the transmission means comprises a gear train drive from the engine and the gear train includes a dog clutching element shiftable in response to operation of the engine starter.

20. An internal combustion engine as set forth in claim 18 wherein the injection system is a fuel air injection system and the pump comprises an air pump.

21. An internal combustion engine as set forth in claim 20 wherein the transmission means comprise a gear train drive from the engine and the gear train includes a dog clutching element shiftable in response to operation of the engine starter.

22. An internal combustion engine as set forth in claim 18 wherein the engine is water cooled and wherein the pump is cooled by the coolant from the engine.

23. An internal combustion engine as set forth in claim 22 wherein the pump is a reciprocating pump having a cylinder block and cylinder head each formed with a cooling jacket.

* * * * *